US005680775A

United States Patent [19]

Manley

[11] Patent Number: 5,680,775

[45] Date of Patent: Oct. 28, 1997

[54] DEMIXING SIDEDRAWS FOR DISTILLATION COLUMNS

[76] Inventor: David B. Manley, 11480 Cedar Grove La., Rolla, Mo. 65401

[21] Appl. No.: 587,238

[22] Filed: Jan. 12, 1996

[51] Int. Cl.[6] ..... F25J 1/00

[52] U.S. Cl. ..... 62/630; 62/935

[58] Field of Search ..... 62/630, 935

[56] References Cited

U.S. PATENT DOCUMENTS

| | | | |
|---|---|---|---|
| 1,735,558 | 11/1929 | Youker . | |
| 1,954,839 | 4/1934 | Youker . | |
| 1,957,818 | 5/1934 | Carney | 196/11 |
| 2,138,218 | 11/1938 | Raidgorsky . | |
| 2,327,134 | 8/1943 | Schuftan | 62/935 |
| 2,327,643 | 8/1943 | Houghland . | |
| 3,956,415 | 5/1976 | Cummings et al. | 62/935 |
| 4,277,268 | 7/1981 | Spangler, Jr. . | |
| 4,285,708 | 8/1981 | Politte et al. | 62/28 |
| 4,336,046 | 6/1982 | Schorre et al. . | |
| 4,430,102 | 2/1984 | Tedder | 62/935 |
| 4,436,540 | 3/1984 | Dowd et al. | 62/30 |
| 4,519,825 | 5/1985 | Bernhard et al. . | |
| 4,720,293 | 1/1988 | Rowles et al. . | |
| 4,726,826 | 2/1988 | Crawford et al. . | |
| 4,900,347 | 2/1990 | McCue, Jr. et al. . | |
| 5,035,732 | 7/1991 | McCue, Jr. . | |
| 5,253,479 | 10/1993 | Di Cintio et al. | 62/24 |

OTHER PUBLICATIONS

"Temperature–Heat Diagrams for Complex Columns, 2. Underwood's Method for Side Strippers and Enrichers" (N.A. Carlberg et al, Ind. Eng. Chem. Res., vol. 28, pp. 1379–1386, 1989).

Ng et al., "Ethylene from NGL feedstocks", *Hydrocarbon Processing,* Dec. 1983, pp. 99–103.

Kister et al., "Ethylene from NGL feedstocks", *Hydrocarbon Processing,* Jan. 1984, pp. 105–108.

*Primary Examiner*—Ronald C. Capossel
*Attorney, Agent, or Firm*—Daniel N. Lundeen

[57] ABSTRACT

The present invention provides one or more sidedraws, from the stripping section of a column, of a heavy key component in the presence of a desirable heavier than heavy key component. In addition, the present invention provides one or more sidedraws, from the rectification section of a column, of a light key component in the presence of a desirable lighter than light key component. In prior art columns, an inherent remixing of the components to be separated in downstream columns occurs near the top or bottom of refluxed or reboiled columns respectively. In the prior art, a re-separation of the remixed components from an upstream column must be done in downstream columns. The present invention eliminates or reduces, according to desired optimization, the remixing by removal of the heavy or light key components in the sidedraw stream.

48 Claims, 11 Drawing Sheets

Figure 1A
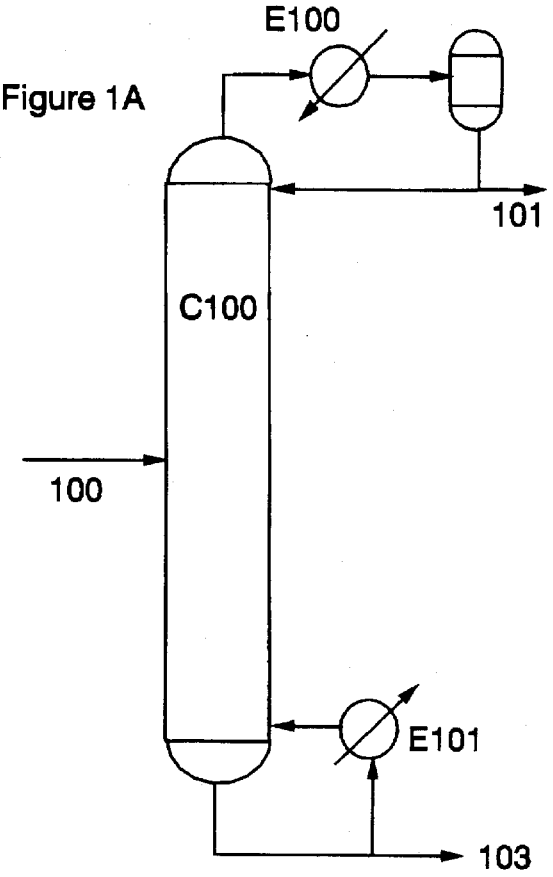
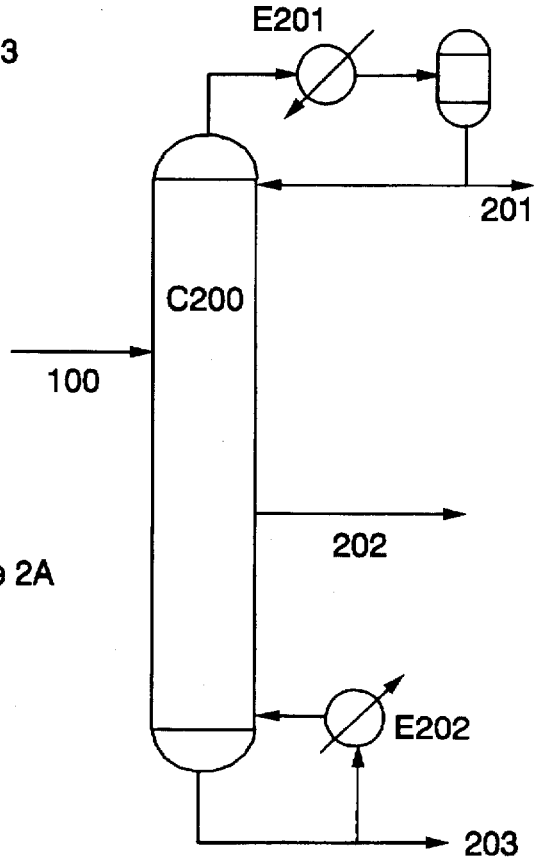
Figure 2A

DEMIXING SIDEDRAWS FOR DISTILLATION COLUMNS

BACKGROUND OF THE INVENTION

The present invention relates to distillation column separation of components, especially where an overhead or bottoms product will be further separated in a downstream column. In some embodiments, the present invention relates to separation of light hydrocarbons, such as NGL components and ethylene from ethane.

In contrast to advances in NGL demethanization and related nitrogen recovery units, NGL depropanization and debutanization have seen relatively few major improvements. The low cost cold utilities for condensation of reflux are a factor in the lack of development. Cooling water is typically used for overhead vapor condensation for NGL depropanization and debutanization, and a factor in choosing the column pressure is whether the overhead vapor will partially or completely condense with just cooling water. However, the hot utilities, typically for reboiling, can be a significant part of operating expense, thereby making a lower column pressure preferable to reduce reboiling temperature and the temperature of the hot utilities. For both the hot and cold utilities and fractionation devices, reducing equipment size is an important goal due to the large volumes of NGL processed in a typical plant. The following description of the prior art is exemplary of NGL and fractionation art related to the present invention.

U.S. Pat. No. 1,735,558 describes a multiple sidedraw column crude oil fractionation column. The vapor from three sidedraws from a first column is partly condensed and is condensed and rectified in a second column. The liquid of the second column is returned to the first column for stripping.

U.S. Pat. No. 1,954,839 describes a distillate rectification in which a the feed is partly vaporized and the vapor and liquid phases separated three times to provide for multi-level feeds to a fractionation column. The liquid separated from the last of partial fractionation stages is recovered as the distillate product.

U.S. Pat. No. 2,138,218 is dual column stabilizer for natural gasoline, making a split in the normal butane between the overhead and natural gasoline products. In this patent, a gas feed is compressed and partially condensed. The vapor from the partial condensation is further compressed and condensed, then is fractionated at a relatively high pressure. The liquid from the first partial condensation is fractionated in a separate, relatively lower pressure column. The vapor overhead product from the lower pressure column is completely condensed and supplies reflux to both the high and low pressure columns.

U.S. Pat. No. 2,327,643 describes a two column, heat pumped deisobutanizer. A first column generates a bottoms stream which is fed to the middle of a second column. A condensed overhead product of the second column is flashed to a lower pressure, vaporized to indirectly provide part of the condensing duty for the overhead vapor stream of the first column.

U.S. Pat. No. 4,277,268 describes a dual pressure, heat pumped depropanization. The rectification and stripping sections are separate pressure vessels, wherein the vapor from the lower pressure stripping section is compressed and fed to the bottom of the higher pressure rectification section. The higher pressure liquid from the bottom of the rectification section is expanded and fed to the top of the stripping section.

U.S. Pat. No. 4,336,046 describes an open cycle, heat pumped normal butane and isobutane fractionation. A vaporized portion of the normal butane product is compressed and acts as the heat pump medium. The compressed vapor-phase normal butane is returned to a stripping section tray. The patent further describes a reduction in "external" hot reboiling utilities when this method is used.

U.S. Pat. No. 4,720,293 describes a method of feed conditioning to a demethanizer for an olefins fractionation train. The fractionation train's first separation column is the demethanizer, and the feed to it is treated in a dephlegmator to recover ethylene. Column 100 describes a pasteurizing section accommodating removal of residual hydrogen from an overhead ethylene product.

U.S. Pat. No. 4,900,347 describes a system of multiple dephlegmations integrated into a demethanization of an olefins recovery stream. The multiple rectifications in three dephlegmators produce three liquid bottoms streams that are fed to two refluxed demethanization columns. A dephlegmated portion of the feed gas is fed to a second demethanizer column. The overhead product of a first demethanizer is also fed to the second demethanizer. The bottom product of the second demethanizer is a relatively pure stream of ethylene.

U.S. Pat. No. 5,035,732 describes a system similar to that of U.S. Pat. No. 4,900,347, although the second demethanizer is operated at low pressure.

U.S. Pat. No. 4,519,825 describes a C4+ recovery from refinery hydrogenation processes or off-gases using a dephlegmator as the sole fractionation device. It is known that dephlegmators, as currently offered by equipment manufacturers, must maintain a relatively high ratio of vapor to liquid flow within the heat transfer surfaces of the device. The narrow passages that enhance turbulence and heat transfer also are prone to flooding at vapor and liquid flows typical of fractionation columns. A relatively low level of C4+ can be processed in this way. The feed must have less than 15 mole percent C4+, although the liquid product is only about 75 mole percent C4+.

In the article "Temperature-Heat Diagrams for Complex Columns, 2. Underwood's Method for Side Strippers and Enrichers" (N. A. Carlberg et al, Ind. Eng. Chem. Res., vol. 28, pp. 1379–1386, 1989), complex columns are described as having benefits and disadvantages. On page 1385, the authors state, "The question to ask is how do complex columns compare against simple column sequences in terms of utility consumption. The answer is that complex columns are more energy efficient but have larger temperature ranges than simple column sequences. Basically, complex columns are more favorable with respect to first-law effects and less favorable with respect to second-law effects. Thus, if there is an adequate temperature driving force, complex columns will be favored; if not, simple columns are more favorable from a utility point of view." A method is presented in the article for evaluating minimum reflux for complex column, i.e. those with one or more side strippers or enrichers. In the article, the operational definition of a side stripper or enricher is a device that withdraws from a column a side-stream vapor or liquid and returns to the same stage a stream comprising liquid or vapor generated in a second column. Side stripping or enriching necessarily returns to the fractionation column a portion of the withdrawn stream which has been enriched or stripped of its original components. The above quotation with respect to efficiency of complex columns may only be applied in a relatively narrow sense. The article's comparisons of complex and simple columns have been made without an attempt at energy-saving integration of heating and cooling duties of the process by using interexchangers and/or product coolers and heaters. It would be poor procedure to design a fractionation system without having at least attempted such heat integration. From the above prior art NGL fractionation systems, it will be readily appreciated that heat integration can bring about dramatic changes in efficiency, thus restricting the application of the above quotation to non-integrated system comparisons.

SUMMARY OF THE INVENTION

The present invention is one or more vapor or liquid sidedraws from a multistage rectification or stripping section wherein from 5–95 mole percent of a desired rectified overhead product or stripped bottom product is withdrawn in the sidedraw. One liquid or vapor sidedraw per section is preferable, and the following disclosure will refer to such single sidedraws, although a plurality of sidedraws may be preferable in another embodiment of the present invention. No part of the sidedraw stream containing the 5–95 mole percent of a desired overhead or bottom product is returned to the rectification or stripping zone. Additional stripping or rectification section stages are preferable, although a less efficient or incomplete recovery of a desired component may be achieved by the present invention without such additional stages.

The present invention is most easily appreciated from stage to stage examination of relative amounts of "light key" and "heavy key" components which are adjacent in the boiling point order and which are respectively recovered as overhead and bottom products in fractional distillation of a multicomponent mixture. As used herein, the analysis of "key" components in a fractionation zone may optionally include not only single components, such as propane and isobutane in depropanization, but also may include other components which are adjacent in the boiling point order of the multicomponent mixture. For example, ethane and propane may be characterized as a "light key" and isobutane and normal butane may be characterized as a "heavy key" in a depropanization of NGL, even with the presence of other lighter or heavier components in the overhead or bottom products respectively.

For prior art fractionation zones, it has been found that lighter than light key components are remixed with the light key by the refluxed liquid near the top of rectification sections and heavier than heavy key components are remixed with the heavy key by the reboiled vapors near the bottom of stripping sections. The "remixing" effect is described by specific examples below and shown graphically by plotting of relative amounts of components in NGL fractionation. If lighter and heavier components are to be separated from the light key and heavy key components respectively in downstream fractionation zones, then the remixing near the top and/or bottom of a first fractionation zone must be reversed and the separation repeated in the downstream fractionation zones. The additional separation in the downstream fractionation zones is often a significant cost in terms of utilities and equipment cost. The specific examples below will demonstrate the surprising degree of savings to be effected by the present invention in NGL fractionation by optimized use of the present invention.

Using the present invention, the remixing inefficiency of prior art fractionation zones will not occur or can be reduced, depending on desired optimization,. Remixing near the top of a first fractionation zone can optimally be eliminated by adding additional stages to the rectification section, making a "demixing" sidedraw of a mixture of the light key and lighter components from the rectification section and recovering the lighter than light key components at a desired purity as an overhead product. And the remixing near the bottom of a first fractionation zone can optimally be eliminated by adding additional stages, withdrawing a "demixing" sidedraw of a mixture of the heavy key and heavier components from the stripping section and recovering the heavier than heavy key components at a desired purity as a bottom product.

Where upstream fractionation has not partially fractionated or incompletely separated components to be separated in a column according to the present invention, the overall economic benefits of reduced utilities and lower equipment cost are significant when the light key and lighter components and heavy key and heavier components are relatively close boiling in comparison with the relative boiling differences between the light and heavy key components. Examples of such close boiling separations are isobutane/butane, ethane/ethylene and propylene/propane. Prior art separations of those close boiling separations typically require large, highly refluxed columns. The present invention is also of significant value for relatively wide boiling separations, such as ethylene/propylene, ethane/propane and propane/normal butane.

In the separation of ethane and propane from isobutane and normal butane, the present invention produces a bottom product of normal butane at product specification upon withdrawal of an optimum amount of the remaining C4's as a liquid or vapor sidedraw from the stripping section. Surprisingly, when the sidedraw is liquid and the normal butane bottom product is optimized for relative amounts of isobutane and normal butane in the feed to the fractionation zone, no additional hot utilities are required for operation of the stripping section. Even more surprisingly, no additional cold utilities required for a rectification section connected to the stripping section to separate ethane and propane from normal butane and isobutane. Reboiling and reflux duties are essentially the same in such a case. In another embodiment of this separation, a vapor sidedraw instead of a liquid sidedraw from the stripping section increases reboiling duty for the stripping section to effect product purity normal butane, but the optimum recovery of normal butane bottom product is proportionally higher.

It will be appreciated by the skilled person with the disclosure herein that increasing the hot and cold utilities with optional increases in the number of stages in the stripping and/or rectification sections will improve the recovery and/or purity of the lighter than light key components or heavier than heavy key components in the overhead or bottoms products respectively. The specific examples of the examples below are optimized for operation of NGL fractionation with commonly encountered feeds.

Hereafter, the term "column" will refer to the fractionation zones described above without restriction to devices with contiguous vertical pressure shells. The present invention relates to the withdrawal of key components from stripping or rectification sections without restriction to single vessel separations. The distribution of a fractionation zone to a plurality of single, vertical vessels or pressure shells will still mean a "column" for the present invention described herein.

In the separation of isobutane product, normal butane product and significant amounts of C5+ components as a gasoline product from NGL, the present invention reduces overall utilities by a demixing sidedraw from the rectification section of a debutanizer column. The overhead product of the debutanizer is a product grade isobutane, and the demixing sidedraw contains the remaining isobutane and normal butane. The demixing sidedraw fed to a deisobutanizer, wherein the isobutane and normal butane are separated. The isobutane in the deisobutanizer feed has been reduced by recovery in the overhead of the debutanizer. The reduction in utilities and equipment cost will be proportional to the relative amounts of isobutane to normal butane in the debutanizer feed.

BRIEF DESCRIPTION OF THE DRAWINGS

FIG. 1A is a generalized prior art depropanizer column.

FIG. 1B is a plot of the components of the prior art depropanization shown in FIG. 1A. Similarly, the analysis of components in the columns shown in FIGS. 2A, 3A and 4A are shown in FIGS. 2B, 3B and 4B respectively.

FIG. 2A shows the present invention with a stripping section demixing sidedraw for an NGL depropanizer.

FIG. 5E is a graphical plot of the composition profile above the top side draw of the process in the column shown in FIG. 5A.

DETAILED DESCRIPTION OF THE INVENTION

NGL Depropanizer

FIG. 1A shows a conventional depropanizer, column C100, for separating propane from a mixture containing isobutane and normal butane. The feed is typical for a natural gas liquid from which ethane and gasoline have been previously removed. Table 1 gives compositions and conditions for the streams 100, 101 and 103. The component flow rates described in barrels per day are understood to be standard barrels per day and not at stream conditions. The column C100 is designed to operate at about 250 psia so that cooling water can be used to condense the overhead propane product at about 100° F. About 32 MMBtu/hr of hot utility in exchanger E101 is required to reboil the column C100, which is about 10 feet in diameter. About 64 MMBtu/hr of cold utility in exchanger E100 is required to reflux column C100 to produce a liquid ethane and propane product. It is understood by the skilled person that calculation of column diameter is an optimization procedure involving a balancing of pressure drop, effective vapor velocity ranges, liquid and vapor contact devices, and other such considerations. In order to compare relative equipment savings, a column diameter has been calculated so that similar criteria could be applied to the columns needed for the present invention. In the prior art depropanizer of column C100, virtually all of the isobutane and normal butane in the feed are taken from the bottom product in stream 103 and fed to a downstream deisobutanizer for separation of isobutane from normal butane.

Figure 1B:
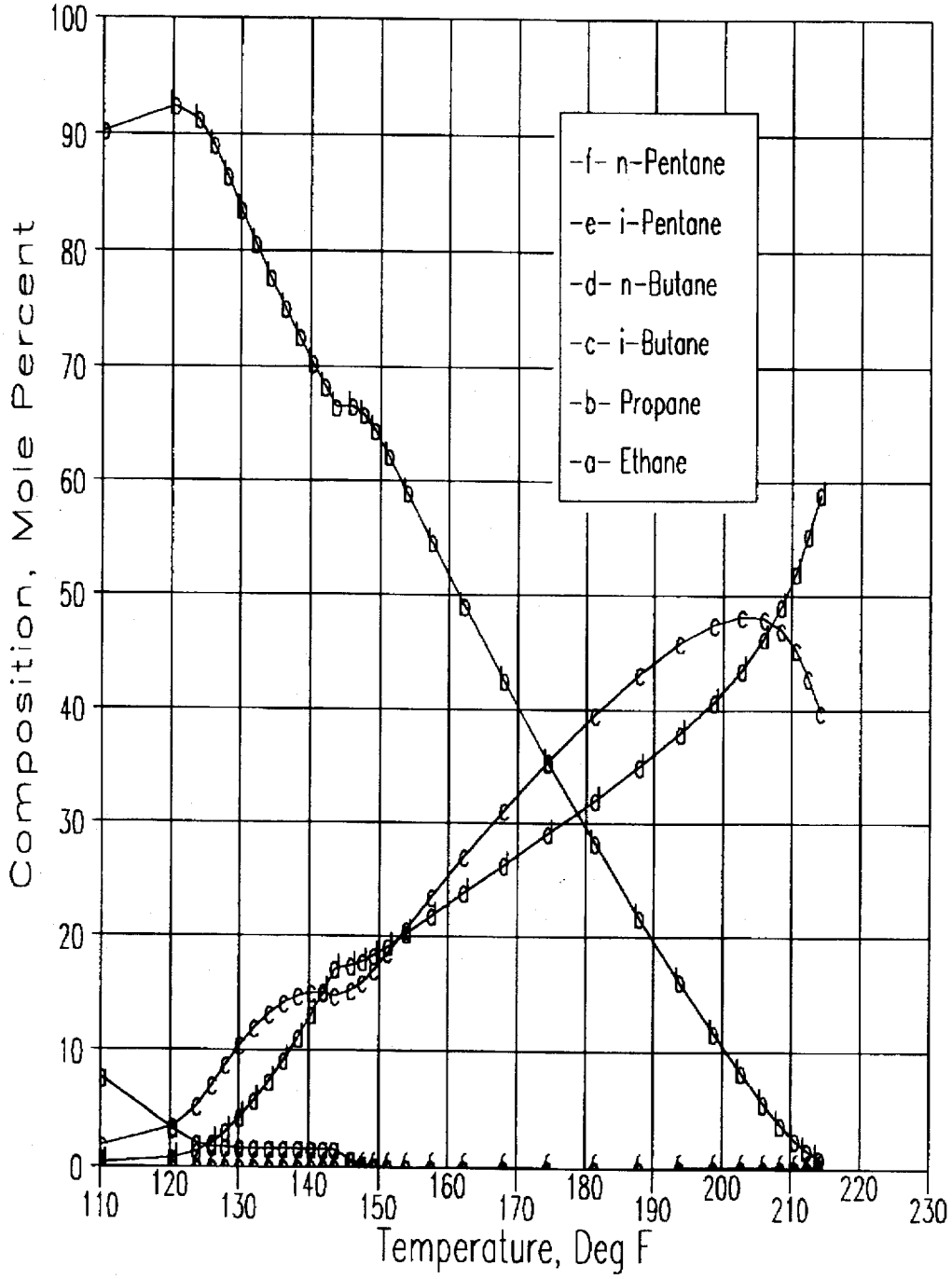
FIGS. 1B, 2B, 3B and 4B are graphical plots of the mole percents of several NGL components, propane, isobutane, normal butane and others, according to the fractionation evaluated, versus the stage temperature of a column. A legend of the components is shown on the Figures, correlating the component with a lower case letter. A theoretical stage in the column is represented by each use of a lower case letter printed on the plot, thereby indicating the stage temperature and the mole percent of the component on that stage.

FIG. 1B shows relative component concentrations as a function of depropanizer stage temperature from the top (at the left side of the plot in FIG. 1B) to the bottom (at the right side of the plot in FIG. 1B) of the column C100 in FIG. 1A. Ethane, isopentane and normal pentane levels are so low in the stripping section that their paths are obscured at the bottom of the plot (this will occur for other component plots as well where some components do not appear clearly on the plot). Isobutane and normal butane are separated as they travel down the column from about 144° F. at the feed to about 195° F., and then they are remixed to about the same ratio as in the feed at about 214° F. at the bottom of the column. This separation and remixing is highly inefficient and generates extra work for the downstream deisobutanizer column. The phenomena of remixing is shown in FIG. 1B as the rate of separation of propane from isobutane slows at the column stages operating about 195° F. and eventually turns negative at stages operating at about 205° F.

FIG. 2A shows a depropanizer with additional stages and a liquid side draw in the stripping section. Column C200 is the depropanizer, exchanger E201 is the point of heat transfer for column C200 reflux cold utilities and exchanger E202 is the point of heat transfer for column C200 reboiling hot utilities. The column feed, stream 100, and stream conditions and column C200 operating conditions are the substantially the same as for column C100 of FIG. 1A, but a bottom product, stream 203, comprises product quality normal butane. Stream 202, a mixture of substantially all the balance of the isobutane and normal butane from stream 100, is a demixing sidedraw withdrawn as a liquid stream. The reboiler duty at exchanger E202 is about 32 MMBtu/hr and the column diameter of about 10 feet are the same as column C100 in FIG. 1A, but a significant number of stages have been added to effect the separation of normal butane from isobutane below the side draw. The refluxing duty of exchanger E201 is substantially the same as that of E100 in the operation of column C100 in FIG. 1. Table 1 gives the compositions and conditions for streams 100, 201, 202 and 203. About 55% of the normal butane in stream 100 has been separated to stream 203 as product quality normal butane without consuming any additional hot utility in E202. This product quality separation in the depropanizer has not previously been contemplated and considerably unloads the downstream deisobutanizer which will be fed with the smaller demixing sidedraw, stream 202. Column C200 FIG. 2A is drawn approximately to scale and indicates the optimum position in the column relative to the feed from which the demixing sidedraw should be taken. In addition, column C100 in FIG. 1A and column C200 of FIG. 2A are drawn to scale with respect to each other and indicate that a substantial number of additional stages (increasing from about 32 to about 85 stages) will be required to obtain an optimum result, i.e., obtaining a maximum amount of product specification bottom product without any change in hot utilities usage in exchanger E202 of FIG. 2A in comparison with the hot utilities used in exchanger E101 in FIG. 1A. It is a discovery of the present invention that the level of hot utilities in a stripping section or the cold utilities in a rectification section depends on the separation of the light and heavy key components between the withdrawal stages for those components. The withdrawal of the lighter than light key component(s) or the heavier than heavy key component(s) as top or bottom products is "free" with respect to utilities, except for a modest change in temperature level (second law effect). The desired purity of those top or bottom products depends primarily (1) on the withdrawal rate of the demixing sidedraw and (2) on the stages added between the draw stage of the demixing sidedraw and the top or bottom stage.

Figure 2B:
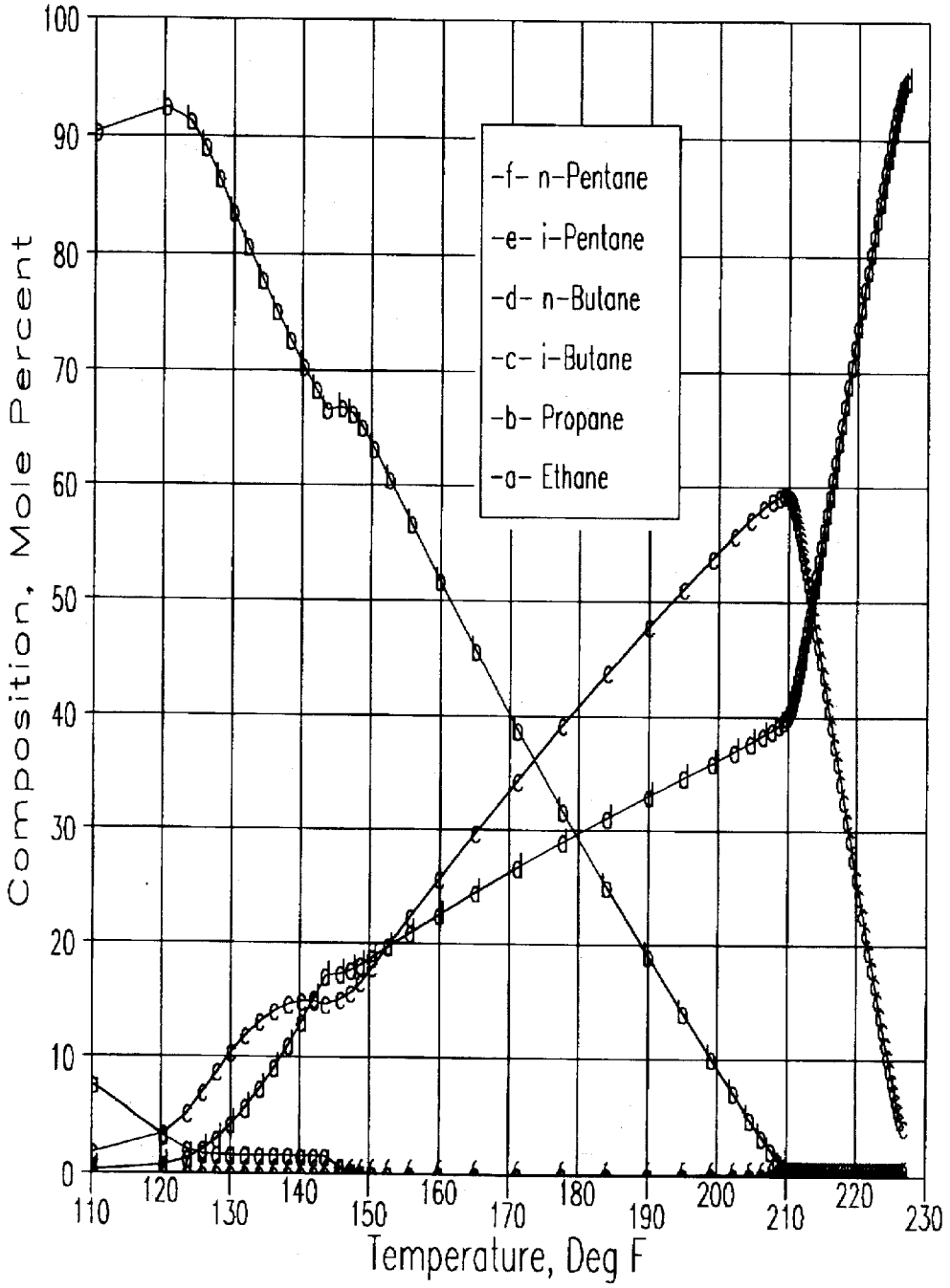

FIG. 2B shows relative component concentrations as a function of depropanizer stage temperature from the top (at the left side of the plot in FIG. 2B) to the bottom (at the right side of the plot in FIG. 2B) of the column C200 in FIG. 2A. Isobutane and normal butane are separated continuously as they travel all the way from about 144° F. at the feed, stream 100, to about 210° F. at the point of demixing sidedraw, stream 202, and no remixing occurs. Below the side draw isobutane is stripped from normal butane to produce the specification, normal butane, bottoms product, stream 203. This significant additional separation requires additional stages and a slightly higher (13° F.) reboiler temperature but no additional pieces of equipment and no additional energy.

For column C200 in FIG. 2A the vapor and liquid tray loadings below the demixing liquid sidedraw, stream 202, are significantly reduced compared with those of the analogous section in column C100 of FIG. 1A. For a liquid demixing sidedraw as described for column C200 in FIG. 2A, a column of uniform diameter would not be fully loaded. However if a vapor, instead of liquid, demixing sidedraw is withdrawn at stream 202, then column C200 becomes more equally loaded. The compositions, stream conditions and column operating conditions for this vapor sidedraw case are also given in Table 1. In this vapor sidedraw case, the reboiler duty increases about 12%, but the normal butane bottoms product rate also increases by about 12%. The significant amount of heat of condensation from the hot vapor from the demixing sidedraw, stream 202, can be integrated elsewhere in the process.

NGL Debutanizer

Figure 3A:
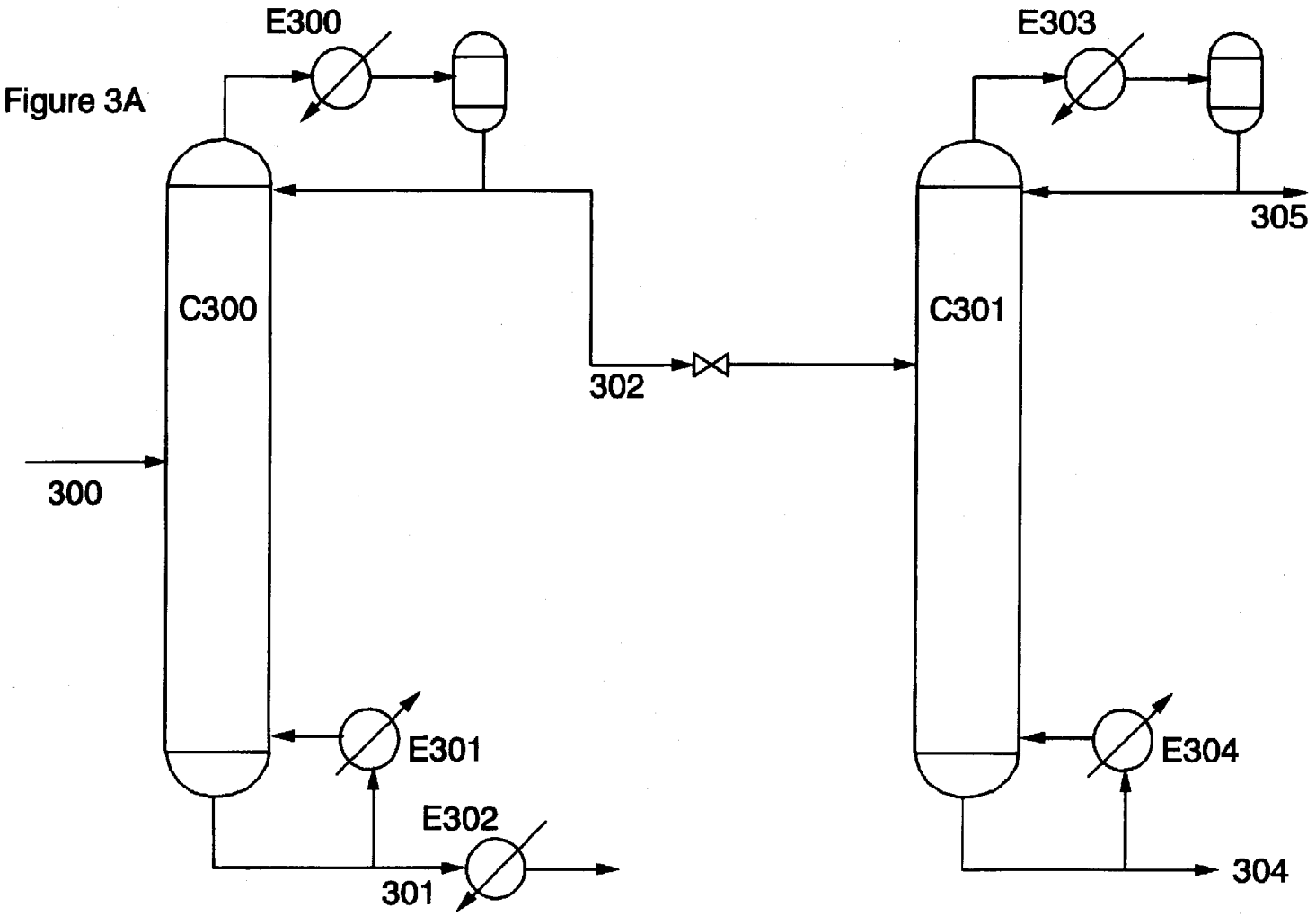
FIG. 3A shows a prior an debutanizer and a downstream deisobutanizer. A further analysis of the system is shown in FIGS. 3C and 3D.

FIG. 3A shows a conventional debutanizer, column C300, and deisobutanizer, column C301, separating a depropanized NGL mixture into isobutane, normal butane, and gasoline products. Table 3 gives compositions and conditions for streams 300 (column feed stream), 301 (debutanizer bottoms gasoline product), 302 (debutanizer liquid overhead isobutane/normal butane stream), 304 (deisobutanizer bottoms normal butane product stream) and 305 (deisobutanizer liquid overhead isobutane product stream). The column C300 is designed for a pressure of about 115 psia. This is an optimized pressure to accomplish heat recovery from the debutanizer condenser, exchanger E300, to the deisobutanizer reboiler, exchanger E304. The process condensing temperature range in exchanger E300 is high enough (about 144° F.) so that at least part of the hot reboiling utilities used in exchanger E304 may be used to reboil column C301. The heat exchange that is advantageous between exchanger E300 and exchanger E304 is shown in FIG. 3A. Column C301, the deisobutanizer, is designed for a pressure of about 80 psia so that its condenser, exchanger E303 can be operated with cooling water at about 100° F.

In describing the rectification sections of the present invention, the top stage of the column rectification section will feed to a condenser an overhead vapor stream which will be at least partly condensed and which will supply at least part of the reflux to the top stage of the rectification section. In addition, the product stream from the overhead of the rectification section, whether vapor or liquid, shall be referred to as the overhead product stream.

The debutanizer condenser, exchanger E300, releases about 60 MMBtu/hr, which indirectly provides to the deisobutanizer about 72% of its required reboiler duty. The remainder is supplied by the debutanizer bottoms cooler, exchanger E302 and/or other hot utility. The total hot utility required for the two column system is about 75 MmBtu/hr. The debutanizer is about 12 feet in diameter and the deisobutanizer is about 14.5 feet in diameter.

Figure 3B:
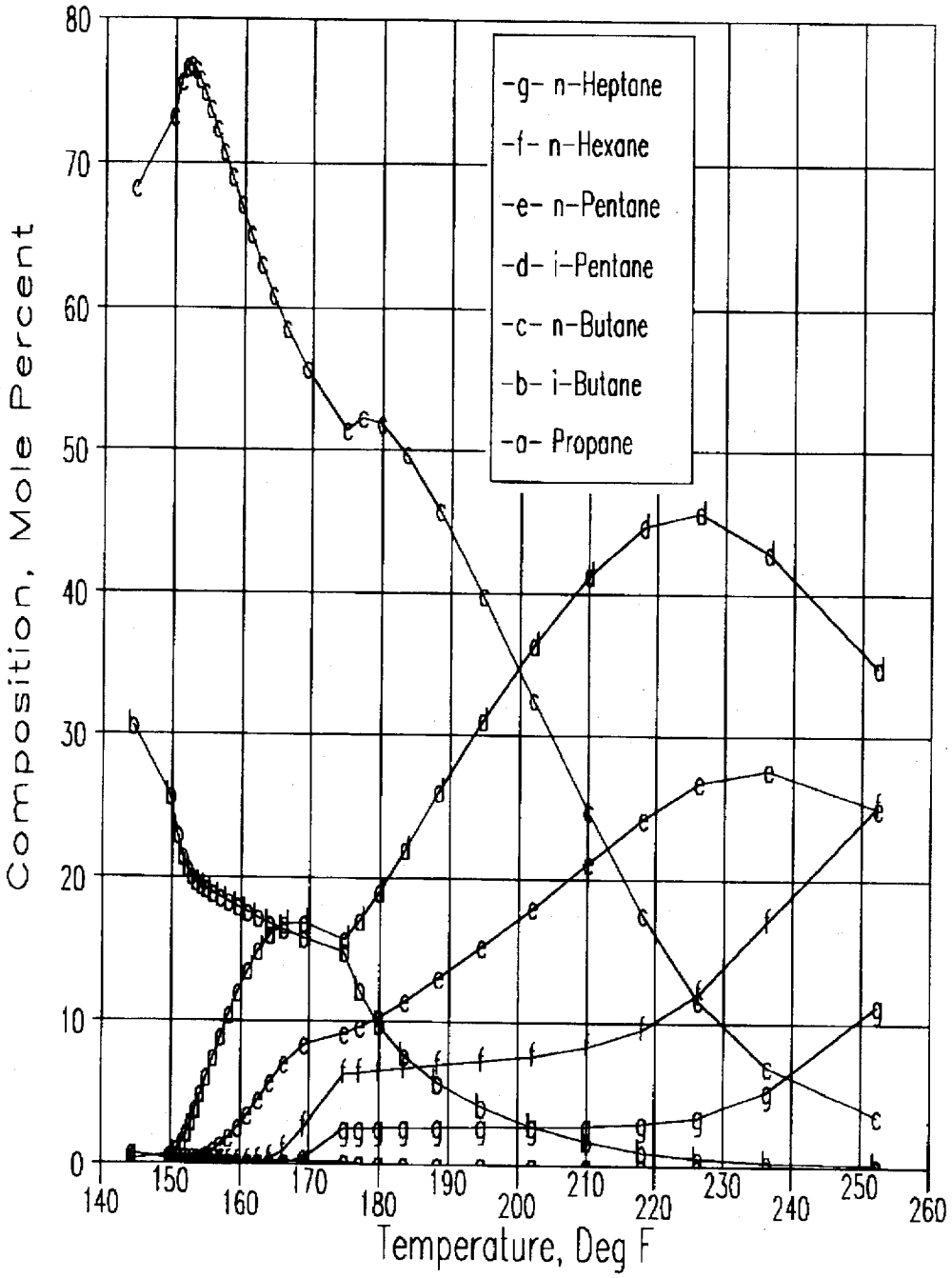
Figure 3C:
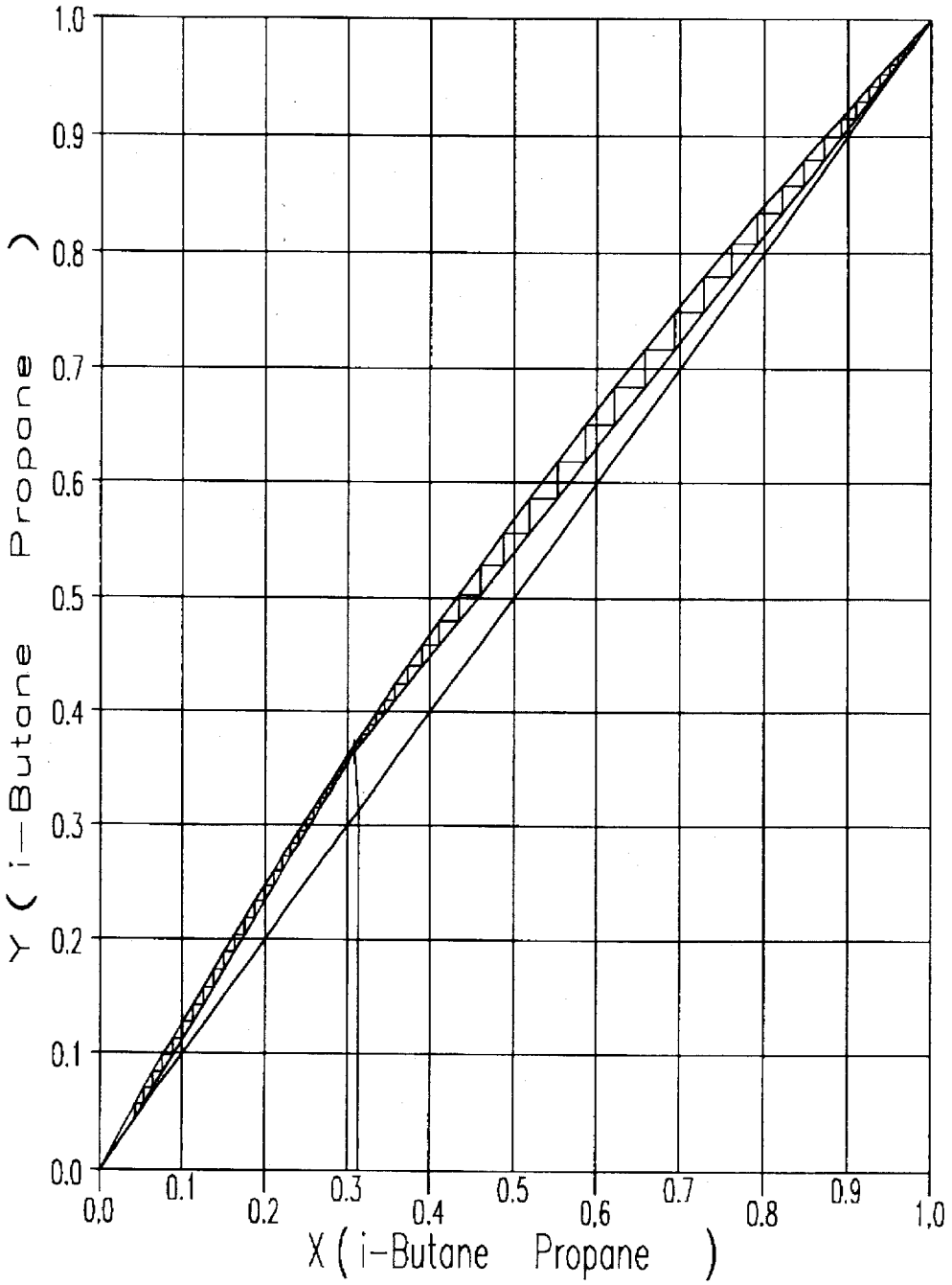
FIG. 3C is a McCabe-Thiele plot of the deisobutanizer, showing the stage by stage vapor and liquid compositions of a combined key component consisting of isobutane and propane.
Figure 3D:
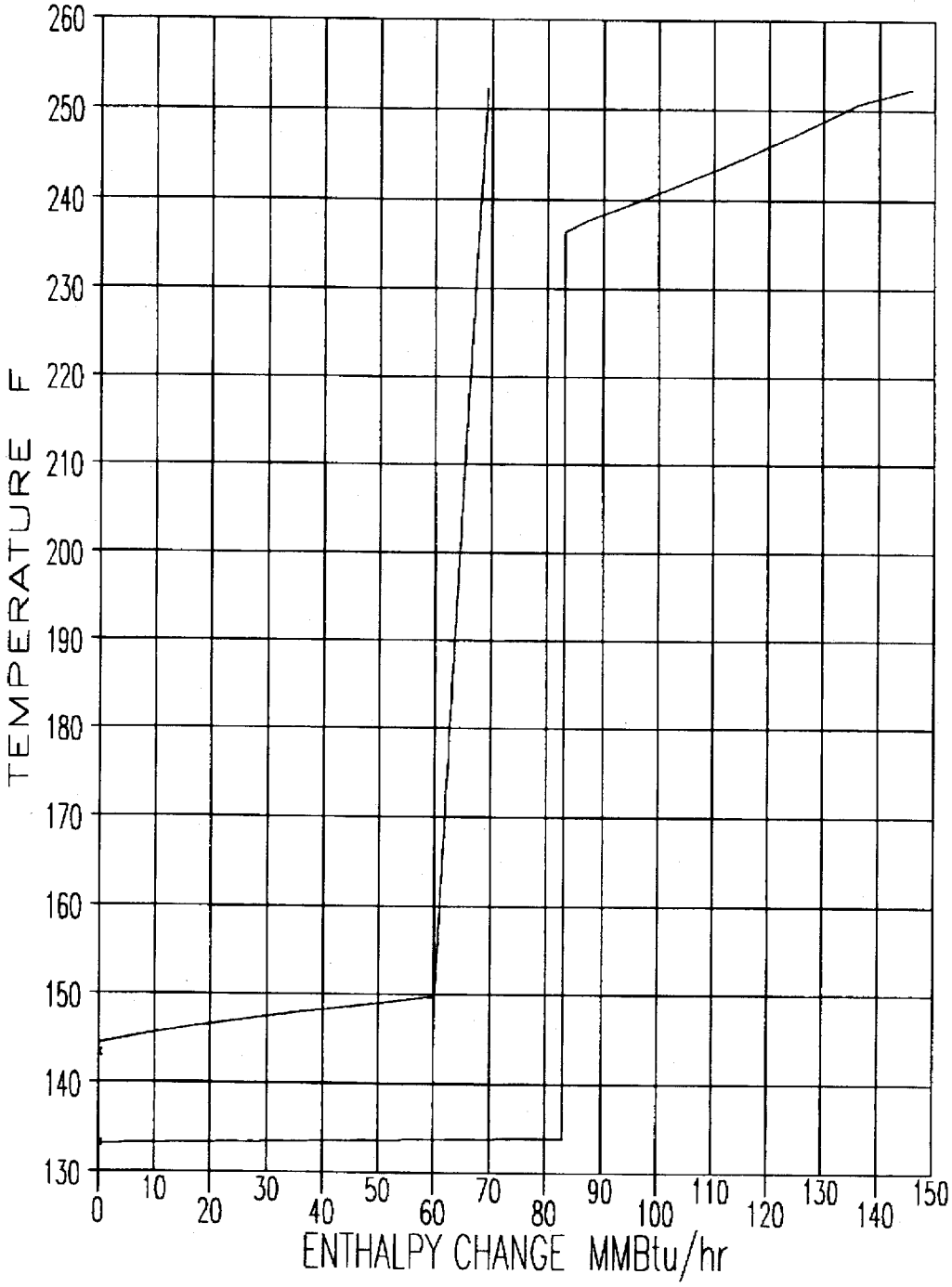
FIG. 3D is a plot of the heating and cooling curves of the process temperatures versus the change in stream enthalpy.

FIG. 3B shows relative component concentrations as a function of debutanizer stage temperature from the top (at the left side of the plot in FIG. 3B) to the bottom (at the right side of the plot in FIG. 3B) of the column C300 in FIG. 3A. Isobutane and normal butane are separated as they travel up the column from about 177° F. at the feed to about 152° F., and then they are remixed to about the same ratio as in the feed at about 144° F. at the top of the column. This separation and remixing is highly inefficient and generates extra work for the downstream deisobutanizer column. FIG. 3C shows a McCabe-Thiele diagram for the deisobutanizer, column C300, with the feed, stream 300, of about 32 mole percent isobutane. This diagram is provided for comparison with the improvement of the present invention using a demixing sidedraw in the rectification section described below. A composite heating and cooling curve, for the process is given in FIG. 3D showing the required total hot utility of about 75 MMBtu/hr, a value which is the total of the hot utilities in exchangers E301 and E304. The combined hot utility value includes credit for the heat which may be recovered from cooling exchangers E300 and E302. Column C300 is about 32 theoretical stages.

Figure 4A:
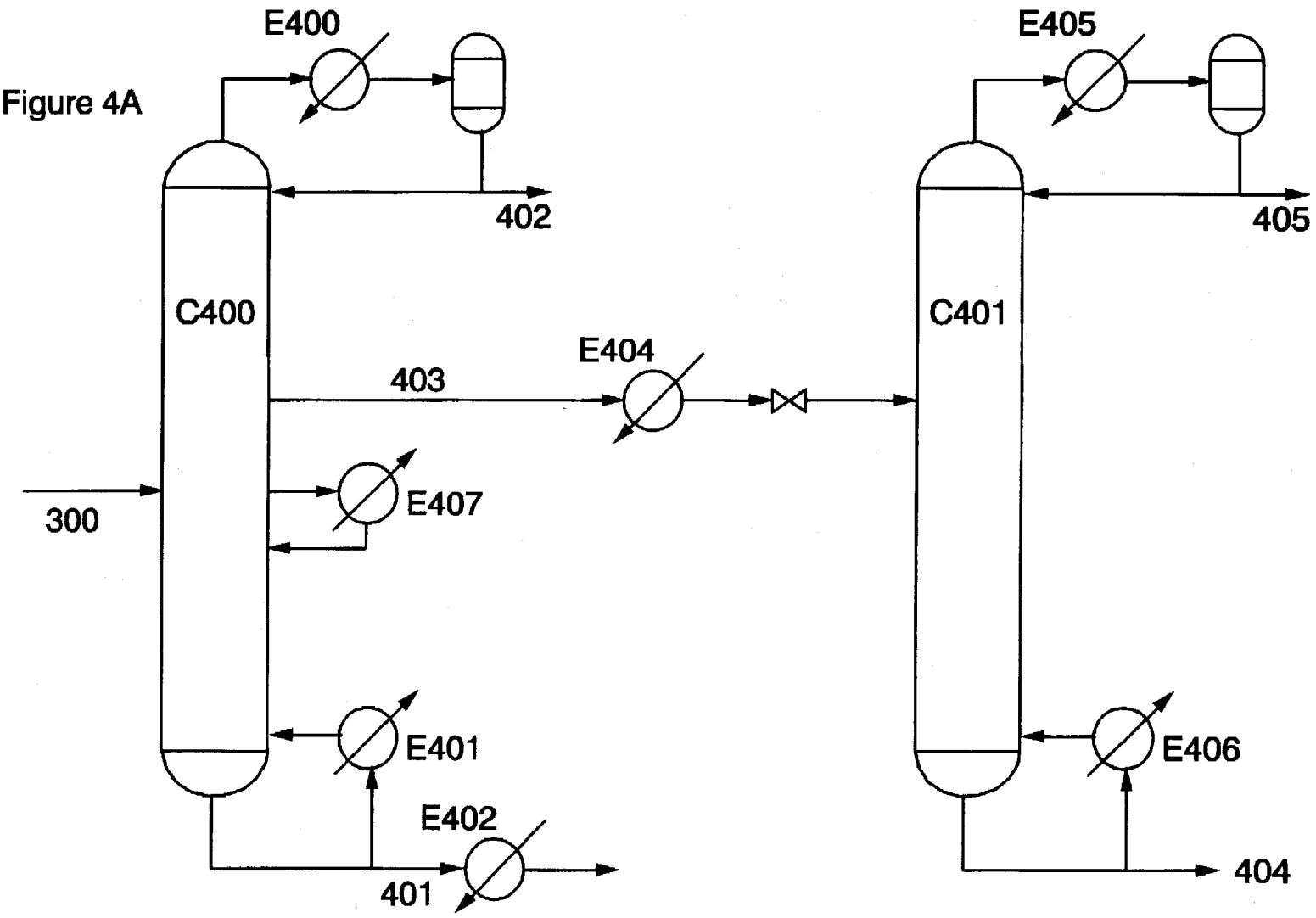
FIG. 4A shows the present invention improvement of a debutanizer and a downstream deisobutanizer. A demixing sidedraw is withdrawn from the debutanizer and becomes the sole feed to the deisobutanizer. A further analysis of the system is shown in FIG. 4D.

FIG. 4A shows a debutanizer, column C400, with about 50 additional stages compared to column C300 described in FIG. 3A, and is supplied with refluxing utilities at exchanger E400 and is partially supplied with reboiling utilities at exchanger E401. A partial interreboiler at exchanger E404 provides the rest of the reboiling utilities to column C400. A bottoms product cooler, exchanger E402, cools the hot bottom product of column C400. A deisobutanizer, column C401, is supplied with refluxing utilities at exchanger E405 and reboiling utilities at exchanger E406. The process streams of FIG. 4A are stream 300 (a feed stream to column C400 and at the same composition and conditions as shown for column C300 in FIG. 3A), 401 (a gasoline bottom product stream from the debutanizer), 402 (an overhead liquid isobutane stream from column C400 at product specifications for isobutane), 403 (a demixing sidedraw from the rectification section of column C400, cooled in exchanger E404 and fed to column C401), 405 (an overhead liquid isobutane stream from column C401 at product specifications for isobutane) and 404 (a normal butane bottoms product stream from column C401 at product specification for normal butane).

Stream 300 is fed to column C400, as in column C300 in FIG. 3A, however, isobutane product is taken from the top of the column as stream 402, and a mixture of isobutane and normal butane is taken as a demixing sidedraw, stream 403. Stream 403 then feeds the downstream deisobutanizer, column C401. Since the overhead product of column C400 is lighter (i.e., lower boiling) than the overhead product of column C300 in the FIG. 3A, column C400 operating pressure is higher (about 25 psi) to integrate the heat recovery from E400 to be used to partially reboil the downstream deisobutanizer at E406. The process stream connection between exchangers E400 and E406 to facilitate heat transfer is not shown in FIG. 4A.

Table 3 gives compositions and conditions for the process streams in FIG. 4A. About 40% of the isobutane in stream 300 is separated as product specification isobutane in an overhead product from the debutanizer, column C400. This considerably unloads the downstream deisobutanizer, C401, which is fed with the sidedraw stream 403, whose flow rate is substantially less than that of the prior art stream to the deisobutanizer, C301, in FIG. 3A. In this FIG. 4A embodiment of the present invention, the debutanizer, column 4A, is about 12 feet in diameter and the deisobutanizer, column C401, is about 13 feet in diameter.

Figure 4B:
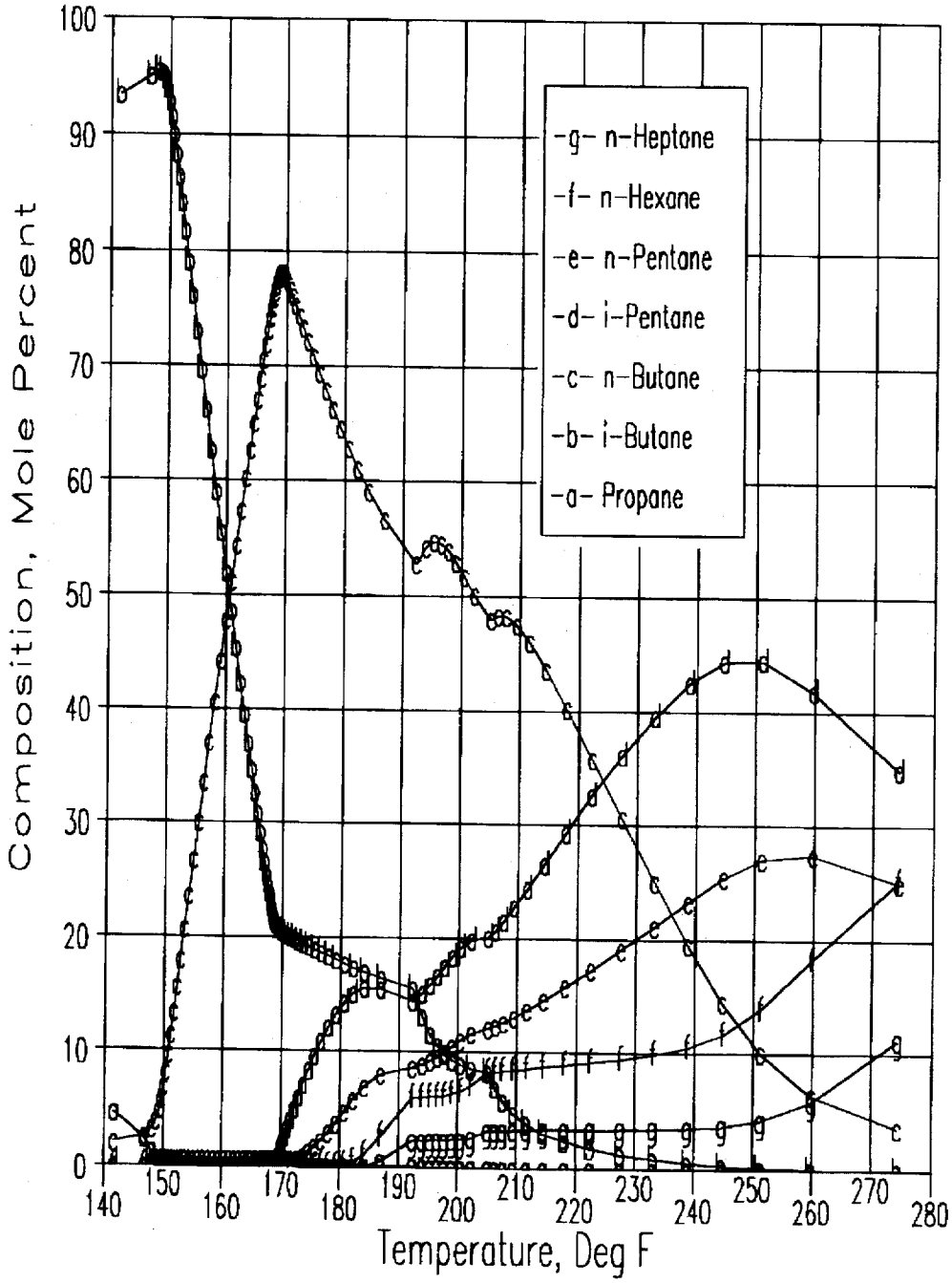

FIG. 4B shows relative component concentrations as a function of debutanizer stage temperature from the top (at the left side of the plot in FIG. 4B) to the bottom (at the right side of the plot in FIG. 4B) of the column C400 in FIG. 4A. Isobutane and normal butane are separated continuously as the travel all the way from about 177° F. at the feed, stream 300, to about 168° F. at the sidedraw, stream 403, and no remixing occurs. Above the sidedraw in column C400, normal butane is absorbed from isobutane to produce an overhead product, isobutane at product specification. This significant additional separation requires additional stages and a slightly higher (22° F.) reboiler temperature, but no additional large pieces of equipment. A McCabe-Thiele diagram (not shown) for the deisobutanizer in the FIG. 4A process with a feed composition of about 22 mole percent isobutane generates a greater slope to the stripping section operating line and consequent lower reboiler duty in comparison with the FIG. 3A process.

The debutanizer condenser, exchanger E400, in the FIG. 4A process releases about 59 MMBtu/hr, which can provide about 88% of the deisobutanizer reboiler duty at exchanger E406. To minimize the hot utility required in column C400, a partial interreboiler, exchanger E404, is optionally heated by indirect heat exchange with stream 401, the hot bottoms product, from exchanger E402. The exchange of process streams between exchangers E402 and E404 to facilitate heat transfer is not shown in FIG. 4A, but that heat transfer is used to recover heat from the hot debutanizer bottoms.

Figure 4D:
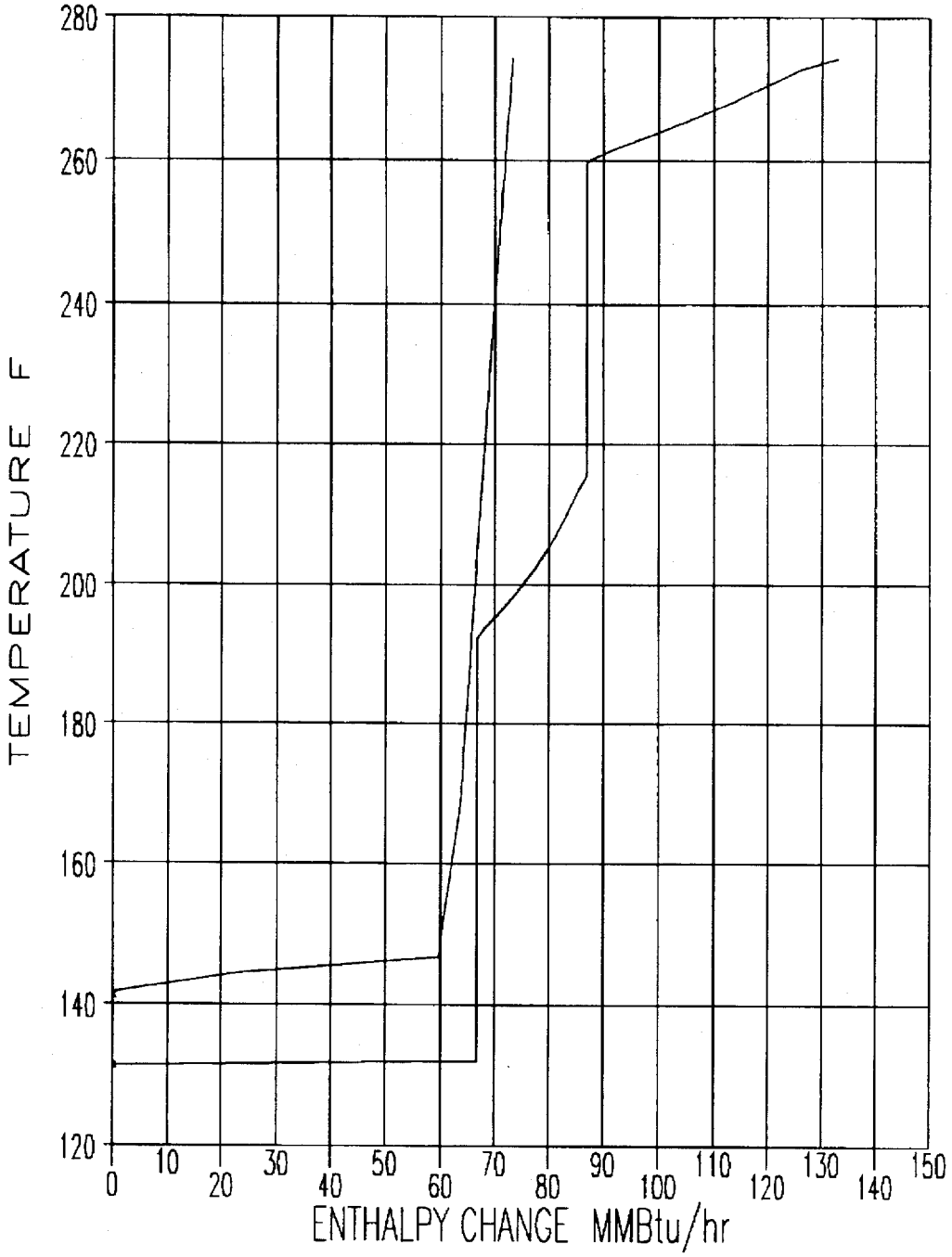
FIG. 4D is a plot of the heating and cooling curves of the process temperatures versus the change in stream enthalpy.

Now shifting from reducing hot utility in the debutanizer to further reducing hot utility to exchanger E406, the deisobutanizer reboiler, the process stream of the debutanizer side draw cooler, exchanger E404, and a remaining amount of heat from the process stream of the debutanizer bottoms cooler, exchanger E402, are used to provide the remainder of the deisobutanizer reboiler duty which was not supplied by process heat transfer from the debutanizer overhead stream in exchanger E400. Thus, the entire reboiling requirements for the deisobutanizer in this optimized example of the present invention is provided by process streams within the process scheme. A composite heating and cooling curve for the optimized process is given in FIG. 4D showing the result of applying the above heat integration improvements to a basic sidedraw demixing for a prior art debutanizer and deisobutanizer. The resulting total hot utility required for the process is about 60 MMBtu/hr. This is about 15 MMBtu/hr less (20%) less than in the FIG. 3A conventional process.

Ethylene Recovery in Sidedraw Demixing

Figure 5A:
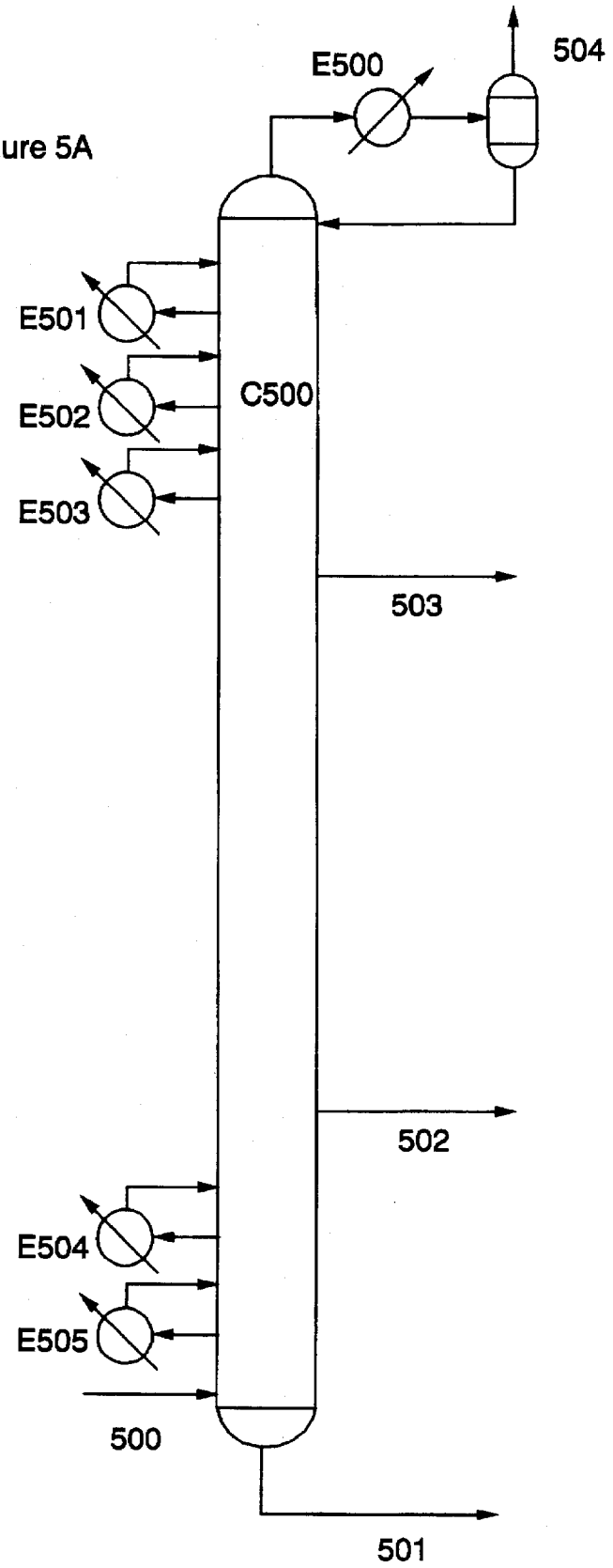
FIG. 5A shows the present invention improvement of an ethylene separation column rectification section. Two demixing sidedraws are withdrawn from the column. Intercondensers are provided to obtain a high purity ethylene product as a demixing sidedraw.

FIG. 5A shows an ethylene recovery column, column C500. Five intercondensers are shown, exchangers E501, E502, E503, E504 and E505, that operate with the column overhead condenser, exchanger E500, to supply condensing utilities to column C500. The portion of column C500 between an upper set of intercondensers, exchangers E501, E502 and E503, and a lower set of intercondensers, exchangers E504 and E505, define a set of column stages from which demixing sidedraws are preferably withdrawn. The column feed, stream 500, is an intermediate processing stream of an ethylene recovery separation process. Pyrolytic generation of ethylene is usually the source of the ethylene-containing stream to processed, although it is known that fluid cracking catalyst processes also generate significant amounts of olefins that could be separated according to the present embodiment relating to ethylene recovery.

The rectification section of column C500 comprises 89 theoretical stages, including the top condensing stage, exchanger E100. For evaluation of the column operation, column stages are divided into upper, middle and lower sections. The top 20 stages, including the top condensing stage, comprise the upper section. The next 50 stages are the middle section. The bottom 19 stages are the bottom section. For location of sidedraws and intercondensers, the stages are numbered so that the top stage in each section is a number one stage and the stage numbers will increase sequentially in each section as the next lowest stage is considered.

For the specific example described below, the following table indicates stage location, cold utility duty of the device used and stage temperature of each of the intercondensers and the overhead condenser.

| Exchanger | Section/Stage | Duty (MMBtu/hr) | Stage Temperature (°F.) |
|---|---|---|---|
| E500 | Upper/1 | 4.14 | −180 |
| E501 | Upper/10 | 6.14 | −145 |
| E502 | Upper/14 | 8.29 | −105 |
| E503 | Upper/17 | 12.77 | −75 |
| E504 | Bottom/7 | 7.83 | −40 |
| E505 | Bottom/13 | 6.43 | −14 |

Three liquid product streams, streams 501, 502 and 503, are produced from the ethylene recovery column, column C500. Stream 501 is the bottoms liquid product stream. Stream 502 is a lower demixing sidedraw stream primarily comprising ethylene and ethane withdrawn from stage 50 of the middle section. Stream 503 is an upper demixing sidedraw stream comprising mostly ethylene, preferably at about 92 weight percent ethylene or less, under the column conditions and stream compositions presented in this specific example. Increasing intercondensing utilities in the upper section will probably cause additional methane to be recovered into stream 503, an undesirable effect. Stream 503 is withdrawn from stage 20 of the upper section. An overhead vapor product stream, stream 504, preferably comprises essentially only trace amounts of ethylene or heavier components of the feed stream, stream 500, although some ethylene may pass to stream 504 while still obtaining the benefits of the present embodiment. Table 5 describes component flow rates and conditions for the process streams in FIG. 5A.

Although FIG. 5A shows two demixing sidedraws, more may be withdrawn to obtain the objects of the present invention. Two demixing sidedraws are withdrawn in the present embodiment to obtain the surprising result of a high purity product from the upper demixing sidedraw, stream 503. The relationship between the number and duties of intercondensing stages, number of sidedraws, phase of the sidedraw, sidedraw withdrawal rate and other operating factors may be changed to obtain the objects of the present invention, although a relatively well-optimized operation is described in the present specific example. The novel and basic concept of the present embodiment is that using single or multiple intercondensing stages with multiple demixing sidedraws will result in a relatively pure upper demixing sidedraw. This concept will also be applicable and analogous to column stripping sections, wherein single or multiple interreboiler stages and multiple demixing sidedraws may be advantageously used to obtain a lower demixing sidedraw with a relatively higher purity product than that of a higher demixing sidedraw.

The upper demixing sidedraw, stream 503, is a relatively ethane-free stream, comprising about 28 weight percent of the ethylene in the feed stream, stream 500. As noted above, the ethylene purity is about 92 weight percent for that upper demixing sidedraw. This remarkable separation of ethylene from ethane in the presence of extremely high proportional levels of hydrogen and methane to obtain a relatively pure ethylene sidedraw stream has not been contemplated in the prior art and is presented as an example of the surprising benefits of practicing the present embodiment.

The upper demixing sidedraw, stream 503, has been sufficiently purified according to the present embodiment that, when stripped of methane and hydrogen and mixed with an overhead product stream of an ethylene/ethane splitter, the combined stream forms product specification ethylene. The operation of the ethylene recovery column may be manipulated to obtain different levels of ethylene purity in the upper demixing sidedraw stream, depending on the desired or optimized operation of a downstream ethylene/ethane splitter and/or according to the product specifications of the product ethylene stream.

Conventional or partial intercondensers may be used for the intercondensing stages. Partial intercondensers were not used in the above specific example of the present embodiment for ethylene recovery. Use of partial, intercondensers for the above example would result in higher and smoother cooling curves (not shown). Those higher and less discontinuous cooling curves for partial intercondensers will obtain a form closer to the cooling curves generated by the continuous removal of heat, as is often achieved in a dephlegmator. However, use of partial intercondensers are not necessary to obtain the major portion of the benefit of the present invention. In addition, the remixing of methane with ethane and ethylene with ethane that necessarily occurs in a prior art dephlegmator process or other highly intercondensed process has been virtually eliminated in the present embodiment. The elimination of remixing results in the above separation of methane and ethylene with virtually no energy overall increase in utilities over a conventional process.

In a further embodiment of the ethylene recovery column, another column, with at least one, preferably upper, intercondenser and at least one demixing sidedraw withdrawn from a stage between the top and bottom stage, is fed at its bottom stage with stream 504 to separate hydrogen from methane. In yet a further embodiment of the ethylene recovery column, when stream 500 contains significant amounts of hydrocarbons heavier than propane, an additional column, similar to the one just described for separation of hydrogen and methane, is fed with stream 500 at its bottom stage to partially separate propylene and propane from the heavier hydrocarbons. The present invention includes the use of columns using demixing sidedraws wherein such columns further fractionate an overhead or bottom product from a column with demixing sidedraws according to the above specific examples.

Side draw products from distillation columns are not new. "Pasteurization" sections in top of columns above a primary side draw product are used in the ethylene/ethane splitters to remove trace amounts of light components, wherein no more than an insubstantial mole percent of a column feed stream is removed as an overhead product. In petroleum refining, sidedraws are used to separate crude fuel fractions for further processing. The prior an does not teach substantial demixing sidedraw separation of a heavier than heavy key component from a heavy key component or such separation of a lighter than light key component from a light key component, especially related to the specific challenges of unloading downstream separation systems such as in the NGL fractionation and ethylene recovery embodiments discussed above.

The sidedraw demixing process is conceptually an absorber process where the upstream absorbers are reflux using recycle flows from the downstream absorbers, and the absorbers can be conceived as the rectifying sections of distributed distillation columns without their associated stripping sections. The sidedraw demixing configuration is mechanically simpler and can be operated at high pressures. Analogously, the sidedraw demixing process is also conceptually an absorber process where stripping sections are reboiled using recycle flows from downstream strippers.

The above specific example obtaining a high purity ethylene demixing sidedraw stream in the presence of high levels of hydrogen and methane can be successfully used in concept for recovery of one or more high purity NGL component streams by an upper demixing sidedraw above a lower demixing sidedraw. A feed stream comprising methane, ethane, propane and C4's would be fed to the bottom stage of a rectification section, wherein the overhead vapor product would consist essentially only methane and ethane. The upper demixing sidedraw would be a high purity propane stream and the lower demixing sidedraw stream would consist essentially of propane and C4's. A rectification section according this NGL, multi-demixing sidedraw embodiment will operate preferably at about less that 500–800 psig, thereby avoiding critical conditions in the column.

Lean oil or solvent absorptions recovering ethylene, propylene, NGL components or the like necessarily require substantial reboiling utilities to remove from the oil or solvent the desired components in a regenerator (stripping) column. Light hydrocarbons are captured in sidedraw naphtha or gasoline range streams from FCC vapor recovery units, wherein the light hydrocarbons must be stripped in strippers from the sidedraw liquids to desired levels. In further embodiments of the present invention relating to withdrawing a one or more demixing sidedraws from a stripping section, the regenerating columns or strippers just described are operated with a demixing sidedraw of partially stripped liquid containing a small portion of the components to be stripped.

As indicated above, the specific examples herein are optimized for recovery of heat from process streams, maintaining utilities at close to prior art levels while obtaining product specification streams, and other objects related above. A lower efficiency or lower purity overhead or bottoms product from a first column may be obtained while still using the concept of the present invention to withdraw a portion of an overhead or bottom product with a demixing sidedraw. An optimum choice of sidedraw tray, sidedraw stream phase and sidedraw withdrawal rate will vary, sometimes considerably, depending on the feed composition and conditions and column operating conditions and available trays in the column. The skilled person will be taught by the above disclosure that the concept of demixing by sidedraw will efficiently reduce prior art column inefficiencies.

TABLE 1

NGL Depropanizer Material Balances

| | Feed | Conventional Depropanizer | | With Liquid Side Draw Demixer | | | With Vapor Side Draw Demixer | | |
|---|---|---|---|---|---|---|---|---|---|
| Stream | 100 | 101 | 103 | 201 | 202 | 203 | 201 | 202 | 203 |
| Vap. Frac. | 1.0000 | 0.0000 | 0.0000 | 0.0000 | 0.0000 | 0.0000 | 0.0000 | 1.0000 | 0.0000 |
| Deg. F. | 144.3 | 110.3 | 241.2 | 110.3 | 208.6 | 226.9 | 110.3 | 209.2 | 226.9 |
| psia | 255.0 | 248.9 | 257.3 | 248.9 | 256.9 | 262.6 | 248.9 | 256.9 | 262.6 |
| lbmole/hr | 5,569 | 4,567 | 1,002 | 4,568 | 648 | 353 | 4,568 | 606 | 395 |
| Mlb/hr | 256.01 | 197.90 | 58.11 | 197.91 | 37.52 | 20.57 | 197.92 | 35.07 | 23.02 |
| barrel/day | 34.195 | 27.263 | 6,932 | 27,266 | 4,512 | 2,418 | 27,266 | 4,223 | 2,706 |
| Comp: barrel/day | | | | | | | | | |
| Ethane | 2,007 | 2,007 | 0 | 2,007 | 0 | 0 | 2,007 | 0 | 0 |
| Propane | 24,634 | 24,575 | 59 | 24,577 | 56 | 0 | 24,578 | 56 | 0 |
| i-Butane | 3,408 | 585 | 2,823 | 584 | 2,715 | 109 | 586 | 2,700 | 122 |
| n-Butane | 4,125 | 97 | 4,028 | 97 | 1,736 | 2,291 | 96 | 1,464 | 2,565 |
| i-Pentane | 20 | 0 | 20 | 0 | 4 | 16 | 0 | 2 | 18 |
| n-Pentane | 2 | 0 | 2 | 0 | 0 | 1 | 0 | 0 | 2 |
| | | Condenser | Reboiler | Condenser | | Reboiler | Condenser | | Reboiler |
| Duty: MMBtu/hr | | 64.01 | 32.15 | 63.89 | | 32.06 | 64.21 | | 35.92 |

TABLE 3

NGL Debutanizer and Deisobutanizer Material Balances

| | Conventional | | | | | With Debutanizer Side Draw Demixer | | | | |
|---|---|---|---|---|---|---|---|---|---|---|
| Stream | 300 | 301 | 302 | 304 | 305 | 401 | 402 | 403 | 404 | 405 |
| Vap. Frac. | 0.0000 | 0.0000 | 0.0000 | 0.0000 | 0.0000 | 0.0000 | 0.0000 | 0.0000 | 0.0000 | 0.0000 |
| Deg. F. | 177.1 | 252.4 | 144.4 | 134.1 | 100.4 | 274.3 | 141.6 | 168.8 | 132.0 | 100.1 |
| psia | 146.0 | 118.2 | 110.0 | 86.2 | 75.0 | 148.6 | 135.0 | 144.0 | 83.7 | 73.0 |
| lbmole/hr | 4,838 | 1,782 | 3,056 | 2,176 | 880 | 1,782 | 400 | 2,656 | 2,175 | 481 |
| Mlb/hr | 317.03 | 139.59 | 177.44 | 126.64 | 50.80 | 139.60 | 23.01 | 154.42 | 126.56 | 27.86 |
| barrel/day | 35,956 | 14,870 | 21,086 | 14,887 | 6,199 | 14,871 | 2,812 | 18,273 | 14,878 | 3,395 |
| Vol. Frac. | | | | | | | | | | |
| Propane | 0.0038 | 0.0000 | 0.0065 | 0.0000 | 0.0223 | 0.0000 | 0.0389 | 0.0016 | 0.0000 | 0.0085 |
| i-Butane | 0.1845 | 0.0010 | 0.3140 | 0.0449 | 0.9600 | 0.0005 | 0.9416 | 0.2178 | 0.0449 | 0.9752 |
| n-Butane | 0.4084 | 0.0290 | 0.6759 | 0.9500 | 0.0177 | 0.0295 | 0.0196 | 0.7765 | 0.9500 | 0.0163 |
| i-Pentane | 0.1391 | 0.3313 | 0.0035 | 0.0049 | 0.0000 | 0.3313 | 0.0000 | 0.0040 | 0.0049 | 0.0000 |
| n-Pentane | 0.0873 | 0.2352 | 0.0001 | 0.0002 | 0.0000 | 0.2352 | 0.0000 | 0.0001 | 0.0002 | 0.0000 |
| n-Hexane | 0.1112 | 0.2690 | 0.0000 | 0.0000 | 0.0000 | 0.2690 | 0.0000 | 0.0000 | 0.0000 | 0.0000 |
| n-Heptane | 0.0556 | 0.1345 | 0.0000 | 0.0000 | 0.0000 | 0.1345 | 0.0000 | 0.0000 | 0.0000 | 0.0000 |

TABLE 5

| Stream | 500 | 501 | 502 | 503 | 504 |
|---|---|---|---|---|---|
| Vap. Frac. | 1.0000 | 0.0000 | 0.0000 | 0.0000 | 1.0000 |
| Deg. F. | 9.9 | 9.3 | −42.7 | −49.5 | −179.7 |
| psia | 500.0 | 500,0 | 492.3 | 487.3 | 473.8 |
| lbmole/hr | 14,741 | 3,070 | 3,656 | 1,530 | 6,485 |
| Mlb/hr | 299.679 | 102.505 | 97.199 | 39.884 | 60.091 |
| std. barrel/day | 60,083 | 16,123 | 18,163 | 7,326 | 18,471 |

TABLE 5-continued

| Stream | 500 | 501 | 502 | 503 | 504 |
|---|---|---|---|---|---|
| Comp: Mlb/hr | | | | | |
| Hydrogen | 6.546 | 0.071 | 0.101 | 0.044 | 6.330 |
| Methane | 68.636 | 4.079 | 7.743 | 3,280 | 53.534 |
| Carbon Monoxide | 0.199 | 0.005 | 0.009 | 0.004 | 0.182 |
| Ethylene | 130.466 | 29.348 | 64.530 | 36.545 | 0.045 |
| Ethane | 36.838 | 12,253 | 24,572 | 0.011 | 0.000 |
| M-Acetylene | 0.223 | 0.223 | 0.000 | 0.000 | 0.000 |
| Propadiene | 0.152 | 0.152 | 0.000 | 0.000 | 0.000 |
| Propylene | 37.373 | 37.137 | 0.236 | 0.000 | 0.000 |
| Propane | 19.079 | 19.071 | 0.008 | 0.000 | 0.000 |
| 1,3-Butadiene | 0.044 | 0.044 | 0.000 | 0.000 | 0.000 |
| 1-Butene | 0.120 | 0.120 | 0.000 | 0.000 | 0.000 |
| n-Butane | 0.003 | 0.003 | 0.000 | 0.000 | 0.000 |

I claim:

1. A process for operation of a column with a stripping section located below a feed stage, comprising the steps of:

(a) introducing to the feed stage a column feed comprising a heavy key component and at least one heavier than heavy key component;

(b) reboiling the stripping section at least at a bottom reboiling stage;

(c) withdrawing a first liquid or vapor demixing sidedraw stream from a first demixing sidedraw stage of the stripping section between the feed stage and the reboiling stage comprising a mixture of the heavy key component and the heavier than heavy key component having a molar ratio of the heavy key component to heavier than heavy key component higher than that in the column feed;

(d) optionally withdrawing one or more additional vapor or liquid sidedraw streams from the stripping section between the first demixing sidedraw stage and the reboiling stage;

(e) withdrawing a bottom stream from the reboiling stage, wherein at least one of the streams withdrawn in step (d) or step (e) has a higher molar ratio of heavier than heavy key component to heavy key component than that of the column feed.

2. The process of claim 1 wherein no portion of the sidedraw stream or streams from steps (c) and (d) is returned to the column.

3. The process of claim 1, comprising the further steps of:

(f) introducing the demixing sidedraw stream from step (c) to a feed stage in a second column having a stripping section below the second column feed stage; and (g) withdrawing a stream from the second column stripping section enriched in the heavier than heavy key component with respect to the demixing sidedraw stream.

4. The process of claim 3 wherein the first demixing sidedraw stream from step (c) contains at least 5 mole percent of the heavy key component.

5. A process as in claim 4 wherein the feed comprises natural gas liquids.

6. A process as in claim 5 wherein the heavy key component consists essentially of isobutane, normal butane or a combination of isobutane and normal butane.

7. A process as in claim 5 wherein the column is a depropanizer and the first demixing sidedraw stage is located at least 2 stages up from the reboiling stage and 2 stages down from the feed stage.

8. A process as in claim 7 wherein normal butane is the heavier than heavy key component and the bottom stream comprises product specification normal butane.

9. A process as in claim 4 wherein the first demixing sidedraw stream has a content of at least 30 mole percent of the heavy key component.

10. A process as in claim 4 wherein the sidedraw demixing stream has a content of at least 50 mole percent of the heavy key component.

11. A process as in claim 4 wherein the sidedraw demixing stream comprises at least about 90 percent of the heavy key component entering with the feed and wherein the bottom stream comprises above about 90 mole percent of the heavier than heavy key component based on the amount of the heavy key component and the heavier than heavy key component in the bottom stream.

12. A process as in claim 4 wherein the bottom stream comprises from 5 to 95 percent of the heavier than heavy key component entering with the column feed.

13. A process for separating more and less volatile key components from a feed including at least one other component lighter than the more volatile key component and at least one other component heavier than the less volatile key component, comprising the steps of:

(a) introducing the feed to a feed stage of a column between stripping and rectification sections;

(b) refluxing the rectification section at a top stage;

(c) reboiling the stripping section at a bottom stage;

(d) withdrawing a first demixing sidedraw stream from a demixing stage above or below the feed stage enriched in one of the key components with respect to the key components in the feed;

(e) withdrawing product streams from the top and bottom stages comprising the respective lighter and heavier components wherein at least one of the product streams is essentially free of the key components.

14. The process of claim 13 wherein no part of the demixing sidedraw stream is returned to the column.

15. The process of claim 13 wherein the demixing stage in step (d) is above the feed stage and comprising the further steps of:

(f) feeding the demixing sidedraw stream to a second column below a second column rectification section; and (g) withdrawing a stream from the second column rectification section enriched in the more volatile key component relative to the demixing sidedraw stream.

16. The process of claim 13 wherein the demixing stage in step (d) is below the feed stage and comprising the further steps of:

(f) feeding the demixing sidedraw stream to a second column below a second column stripping section; and (g) withdrawing a stream from the second column stripping section enriched in the less volatile key component relative to the demixing sidedraw stream.

17. The process of claim 13 wherein both product streams are essentially free of the key components and further comprising the step of:

(f) withdrawing a second sidedraw stream from a stage further above or below the feed stage enriched in the other of the key components relative to the first demixing sidedraw stream with respect to the key components in the feed.

18. A process for separating more and less volatile key components from a natural gas liquids feed, comprising the steps of:

(a) introducing the natural gas liquids feed to a feed stage of the column between stripping and rectification sections;

(b) refluxing the rectification section at a top stage;

(c) reboiling the stripping section at a bottom stage;

(d) withdrawing a first demixing sidedraw stream from a first demixing stage above or below the feed stage enriched in either one of the more or the less volatile key components with respect to the key components in the feed;

(e) withdrawing a second stream from a stage further above or below the feed stage than the demixing stage in step (d) enriched in the other of the more or the less volatile key component with respect to the key components in the feed.

19. The process of claim 18 wherein the first demixing stage in step (d) is in the rectification section.

20. The process of claim 19 wherein the column is a deethanizer, the more volatile key component is ethane, the less volatile key component is propane, and a bottom stream comprises propane and heavier components.

21. The process of claim 19 wherein the column is a depropanizer, the more volatile key component is ethane, the less volatile key component is propane, and a bottom stream comprises butane and heavier components.

22. The process of claim 19 wherein the column is a debutanizer, the more volatile key component is isobutane, the less volatile key component is normal butane, and a bottom stream comprises n-butane and heavier components.

23. The process of claim 18 wherein the first demixing stage in step (d) is in the stripping section.

24. The process of claim 23 wherein the column is a deethanizer, the less volatile key component is normal butane, isobutane or a mixture of normal butane and isobutane, the more volatile key component is propane, and an overhead stream is essentially free of propane and heavier components.

25. The process of claim 23 wherein the column is a depropanizer, the less volatile key component is normal butane, the more volatile key component is isobutane and an overhead stream is essentially free of isobutane and heavier components.

26. A process for operation of a column with a rectification section located above a feed stage, comprising the steps of:

(a) introducing to the feed stage a column feed comprising a light key component and at least one lighter than light key component;

(b) refluxing the rectification section;

(c) withdrawing a first liquid or vapor demixing sidedraw stream from a first demixing sidedraw stage of the rectification section between the feed stage and the top stage comprising a mixture of the light key component and the lighter than light key component having a molar ratio of the light key component to lighter than light key component higher than that in the column feed;

(d) withdrawing a second vapor or liquid sidedraw stream from a second sidedraw stage of the rectification section between the first demixing sidedraw stage and the top stage comprising a higher molar ratio of the lighter than light key component to light key component than that of the column feed; and (e) withdrawing an overhead stream from the top stage.

27. The process of claim 26 wherein no portion of the sidedraw streams is returned to the column.

28. The process of claim 26 comprising the further steps of:

(f) feeding the demixing sidedraw stream from step (c) to a feed stage in a second column below a second column rectification section;

(g) refluxing the second column rectification section; and (h) withdrawing a stream from the second column rectification section enriched in the lighter than light key component relative to the demixing sidedraw stream.

29. The process of claim 26 wherein the overhead stream is essentially free of the key components and the second sidedraw stream comprises at least 90 mole percent lighter than light key component.

30. The process of claim 29 wherein the overhead stream comprises mainly hydrogen, methane or a mixture thereof, the second sidedraw stream comprises mainly ethylene, and the demixing sidedraw comprises a mixture of ethylene and ethane.

31. A process as in claim 26 further comprising the step of:

(f) intercondensing the rectification section at a stage or stages between the top stage and the second sidedraw stage of step (d).

32. A process as in claim 31 further comprising the step of:

(g) intercondensing the rectification section at a stage or stages between the feed stage and the first demixing sidedraw stage.

33. A process as in claim 32 wherein the feed consists mainly of hydrogen, methane, ethylene, ethane, propylene and propane and the composition of the second sidedraw stream in step (d) is greater than about 50 mole percent ethylene.

34. A process for operation of a column with a rectification section located above a feed stage, comprising the steps of:

(a) introducing to the feed stage a column feed comprising a light key component and a lighter than light key component;

(b) refluxing the rectification section;

(c) withdrawing a first liquid or vapor demixing sidedraw stream from a demixing sidedraw stage between the feed stage and the top stage comprising a mixture of the light key component and the lighter than light key component having a molar ratio of the light key component to lighter than light key component greater than that in the column feed;

(d) withdrawing a second stream at a stage above the demixing sidedraw stage enriched in the lighter than light key component with respect to the key components in the column feed.

35. The process of claim 34 wherein no portion of the demixing sidedraw stream is returned to the column.

36. The process of claim 34 comprising the further steps of:

(e) feeding the first demixing sidedraw stream from step (c) to a second column at a second column feed stage below a refluxed second column rectification section;

(f) withdrawing a third stream from the second column rectification section enriched in the lighter than light key component with respect to the first demixing sidedraw stream; and (g) withdrawing a fourth stream from the second column from a second column stripping section below the second column feed stage enriched in the light key component relative to the first demixing sidedraw stream.

37. A process as in claim 34 wherein the feed comprises natural gas liquids.

38. A process as in claim 34 wherein the light key component is selected from (1) a mixture of propane and isobutane, (2) isobutane, (3) normal butane and (4) a mixture of isobutane and normal butane.

39. A process as in claim 38 wherein the column is a debutanizer and the sidedraw is withdrawn at least 2 stages down from the top stage and 2 stages up from the feed stage.

40. A process as in claim 39 wherein isobutane is the lighter than light key component and the second stream comprises product specification isobutane.

41. A process as in claim 40 comprising the further step of:

(f) feeding the liquid or vapor demixing sidedraw to a deisobutanizer comprising a reboiler with reboiling duty at least partly supplied by indirect heat transfer with a condensing overhead vapor stream of the debutanizer.

42. A process as in claim 41 wherein the column pressures of the debutanizer and the deisobutanizer are set to accommodate heat transfer in step (f).

43. A process as in claim 42 further comprising the steps of:

(g) cooling a bottoms product from the debutanizer; and (h) partially interreboiling the stripping section of the debutanizer to indirectly supply reboiler duty to the stripping section of the deisobutanizer.

44. A process as in claim 43 wherein the condensing top stage of the overhead vapor stream of the debutanizer, the cooling of the bottoms product stream and the partial interreboiling of the debutanizer indirectly supply all the reboiling duty of the deisobutanizer.

45. A process as in claim 34 wherein the first demixing liquid or vapor sidedraw stream comprises at least about 30 percent of the light key component entering with the column feed.

46. A process as in claim 34 wherein the first demixing liquid or vapor sidedraw stream comprises at least about 50 mole percent of the light key component.

47. A process as in claim 34 wherein the first demixing liquid or vapor sidedraw stream comprises at least about 90 percent of the light key component and an overhead product stream comprises above about 90 mole percent of the lighter than light key component based on the amount of the light key and lighter than light key components in the overhead product stream.

48. A process as in claim 34 wherein an overhead product stream comprises from 5 to 95 percent of the lighter than light key component in the column feed.

* * * * *